United States Patent [19]

Mainhardt

[11] Patent Number: 4,644,930

[45] Date of Patent: Feb. 24, 1987

[54] GUN FOR FIRING A VARIETY OF PROJECTILES

[76] Inventor: Robert Mainhardt, 936 Redwood Dr., Blackhawk Country Club, Danville, Calif. 94526

[21] Appl. No.: 631,911

[22] Filed: Jul. 18, 1984

[51] Int. Cl.[4] ..... F41B 11/00; F41C 21/10

[52] U.S. Cl. ..... 124/58; 124/84; 42/16; 42/77

[58] Field of Search ..... 42/1 G, 1 H, 1 L, 16, 42/1 S, 1 Q, 44, 77; 124/41 R, 57, 58, 67, 76, 84, 85; 89/1.813

[56] References Cited

U.S. PATENT DOCUMENTS

| | | | |
|---|---|---|---|
| 1,217,162 | 2/1917 | Egbers | 42/77 |
| 1,217,347 | 2/1917 | Rosengarten | 42/77 |
| 1,897,992 | 2/1933 | Ailes | 42/1 H |
| 2,117,935 | 5/1938 | Benjamin et al. | 124/84 |
| 2,337,021 | 12/1943 | Barbieri | 42/77 |
| 2,455,101 | 11/1948 | Stevens | 89/1.813 |
| 2,605,756 | 8/1952 | Bertschinger | 124/67 X |
| 2,863,394 | 12/1958 | Losfeld | 42/77 X |
| 2,941,449 | 6/1960 | Reed | 42/16 X |
| 3,300,888 | 1/1967 | Belcher et al. | 42/1 L |
| 3,339,304 | 9/1967 | Knode, Jr. et al. | 42/77 |
| 3,364,817 | 1/1968 | Barton | 89/1.813 |
| 3,384,989 | 5/1968 | Thomas | 42/77 |
| 3,553,876 | 1/1971 | Engler | 42/1 L X |
| 3,640,013 | 2/1972 | Franklin | 42/77 |
| 3,728,809 | 4/1973 | Mulich et al. | 42/1 F X |
| 3,889,652 | 6/1975 | Curtis | 124/41 R |
| 3,956,843 | 5/1976 | Litman | 42/1 G X |
| 3,958,549 | 5/1976 | Johansson et al. | 124/67 |
| 4,038,902 | 8/1977 | Welsh | 89/1.813 X |
| 4,416,183 | 11/1983 | Adams et al. | 89/1.813 X |

OTHER PUBLICATIONS

"4 Guns in One . . . ", brochure by Poly Choke, Hartford, Conn., Hand-Out at 3-30-65 NRA Exhibit.

*Primary Examiner*—Richard T. Stouffer
*Assistant Examiner*—D. Neal Muir

[57] ABSTRACT

A gun is provided which is capable of firing a variety of projectiles driven by a variety of propellants. The barrel may be readily disconnected from the stock of the gun. The breech is designed to receive a standard gauge shotgun shell. Inserts are also provided with the same general configuration of a standard gauge shotgun shell, and when placed into the breech, allow the gun to fire a variety of projectiles. Inserts are provided which allow the gun to fire both center fire and rim fire rounds through a bore in the insert. A rocket insert is also provided which contains a smooth bore and is capable of firing rockets. An inertial firing pin is provided, which operates in conjunction with a floating breech plate. The floating breech plate is used in the firing of compressed gas bottles. A dual action spring drive is provided which is used to provide the necessary force to drive the firing pin and which also absorbs a portion of the recoil.

5 Claims, 13 Drawing Figures

GUN FOR FIRING A VARIETY OF PROJECTILES

BACKGROUND OF THE INVENTION

The present invention relates in general to long guns and handguns and more particularly to a survival and/or sporting gun which is capable of firing a wide variety of projectiles driven by a variety of propellants.

It is known in the prior art to provide long guns and handguns with interchangeable barrels as shown, for example, by U.S. Pat. No. 4,316,339 in which the barrel and cylinder are removable. It is also known in the prior art to provide a weapon capable of firing a plurality of cartridges simultaneously as shown in U.S. Pat. No. 3,720,133. The prior art also discloses weapons which utilize compressed gas containers, as in U.S. Pat. No. 3,830,214 and for firing small rockets as shown by U.S. Pat. No. 3,212,402.

The prior art devices in general provide rather complicated weapons with relatively limited interchangeability of projectiles which may be fired therefrom. Another general disadvantage of prior art devices is that special tools are typically required in order to change barrels.

BRIEF SUMMARY OF THE INVENTION

A primary object of the present invention is to provide a very simple gun with relatively few parts capable of firing a variety of projectiles driven by a variety of propellants.

A further object of the invention is to provide a relatively compact survival gun capable of firing shotgun shells, center fire and rim fire cartridges, rocket rounds and compressed gas cylinder driven projectiles.

A further object of the invention is to provide a gun in which the barrel is readily removed by hand from the stock and in which various projectiles can be fired by simply placing an appropriate barrel insert into the barrel, reconnecting the barrel to the stock and firing the weapon.

Another object of the invention is to provide a gun which is easy to disassemble for cleaning.

Another object of the invention is to utilize a dual action spring which on the one hand drives the firing pin of the weapon and on the other hand, absorbs the recoil upon firing.

A further object of the invention is to provide a weapon which is capable of firing underwater projectiles such as spears, as well as a variety of objects fired through air such as (without limitation) grappling hooks, flares, line and bean bags.

Further objects and advantages of the invention will become apparent from the following detailed description and drawings.

DETAILED DESCRIPTION OF THE DRAWINGS

Figures 1, 1A, 1B, 2, 3, 4, 4A:
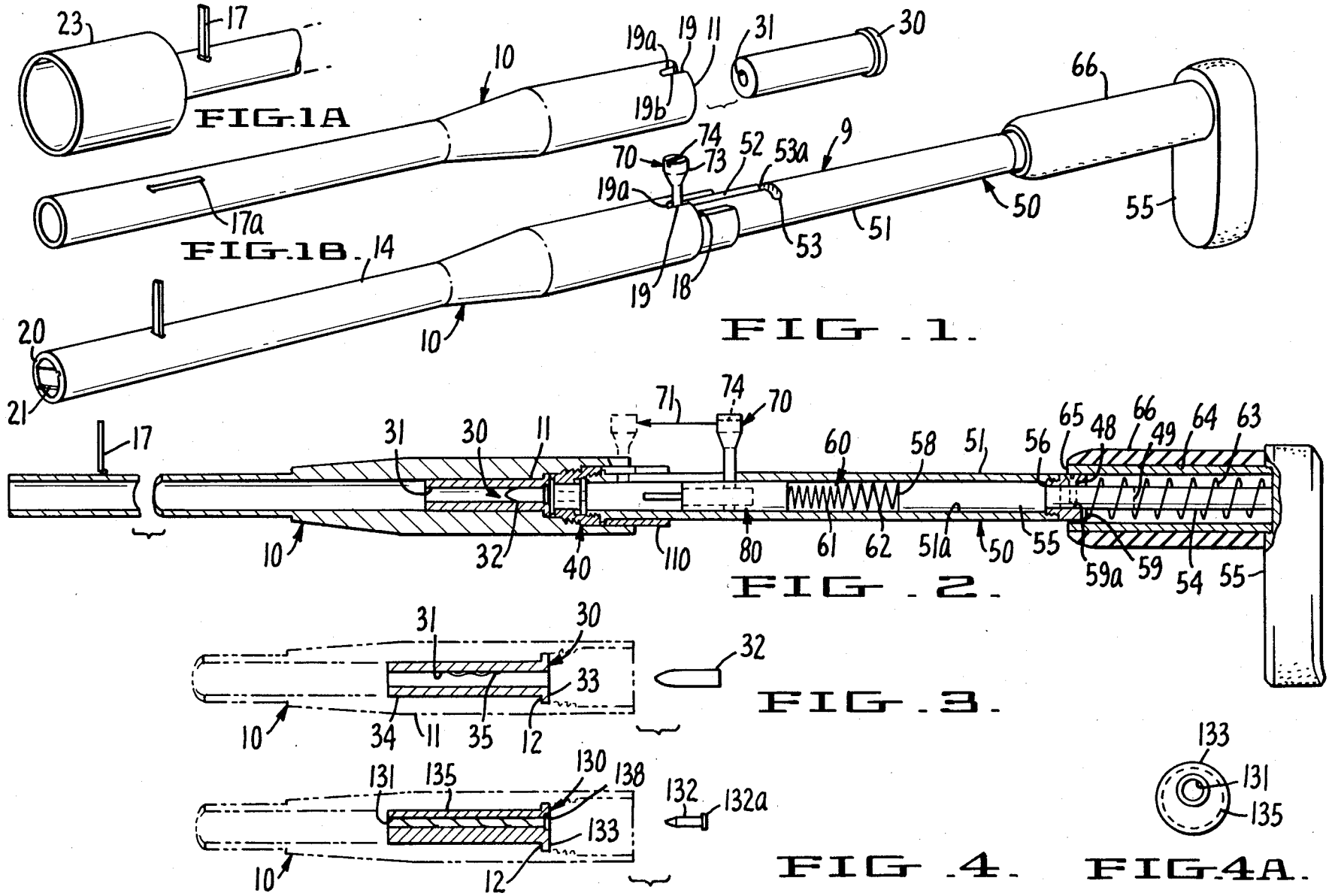
FIG. 1 is a perspective view of the weapon.
FIG. 1A shows an attachment to the tip of the barrel.
FIG. 1B shows the barrel disconnected and shows a barrel insert in a partially exploded view.
FIG. 2 is a sectional view of the gun shown in FIG. 1.
FIG. 3 is a partial sectional view of an alternate barrel insert, capable of firing rocket rounds.
FIG. 4 is a sectional view of yet another barrel insert capable of firing rim fire rounds.
FIG. 4*a* is an elevational view showing the barrel insert used for rim fire rounds.

FIG. 1 shows the gun generally as 9. Barrel means 10 is readily removable from stock means 50 as will be described in detail below. Barrel means 10 is shown in phantom in FIG. 1 as removed from stock means 50. Barrel insert means 30 slides into the breech 11 of barrel means 10 to form a firing chamber for round 32 and enables the user to fire a projectile through the inner bore 31 of insert 30. Alternate inserts are provided for use of alternate projectiles which use a variety of propellants as shown in greater detail below.

Referring to FIG. 2, barrel means 10 is shown connected to stock means 50. Barrel insert means 30 is shown in position with a small rocket round 32 loaded in center bore 31 of insert means 30, ready to be fired.

As shown in FIG. 2, trigger means 70 is shown in its cocked position. Inertial firing pin means 80 is connected to and moves in response to trigger means 70 and is shown in FIG. 2 in its cocked position.

Referring to FIG. 1, stock means 50 comprises a sleeve 51 in which longitudinal slot 52 is formed. Stop 53 is provided at the rear end of slot 52. Trigger means 70 is rotated counterclockwise by a right handed shooter into stop 53. Stop 53*a* is provided opposite stop 53 for a left handed shooter. When trigger means 70 is moved to its cocked position as shown in FIG. 2, it is rotated into and held in stop 53 until fired. To fire the gun, trigger means 70 is rotated from stop 53 into slot 52 where it is driven forward by spring means 60 in the direction of arrow 71 of FIG. 2. After firing, barrel means 10 is disconnected from stock means 50 and the user may reload either the same type of round or may remove barrel insert means 30 and utilize one of the other alternate inserts. Breech 11 of barrel means 10 is designed to receive a 12-gauge shotgun shell. Breech 11 could also be designed to receive a 10 or 8 gauge shotgun shell. If the user desires to fire a 12-gauge shotgun shell, it is not necessary to use barrel insert means 30. The user simply places a 12-gauge shotgun shell into the breech of barrel 10, connects barrel 10 to stock means 50 and proceeds to fire the weapon.

Figure 7:
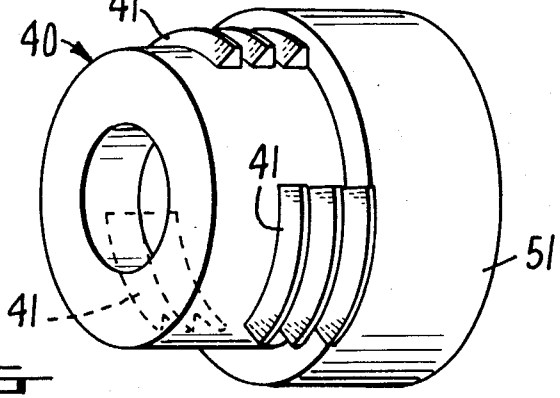
FIG. 7 is a perspective view of the end of the stock shown in FIG. 5.

Quick-connect means 40 is provided for readily connecting and disconnecting barrel means 10 from stock means 50. As shown best in FIGS. 6 and 7, quick-connect means 40 utilizes interrupted and asymmetrical threads 41 formed at the forward end of sleeve 51 of stock means 50. As shown best in FIGS. 5 and 6, barrel means 10 has complementary, asymmetrical interrupted threads 46 formed therein into which interrupted threads 41 are inserted and are locked by a rotation of 60 degrees. The asymmetry of the interrupted threads insures proper registration of the barrel means 10 and stock means 50. Alternatively, asymmetrical bayonet connectors or coarse threads can be utilized. These connectors utilize three or more symmetrical stubs in place of interrupted threads 41 and correspondingly mating slots in barrel means 10. It is also possible to utilize a hinged connection between barrel means 10 and stock means 50. Barrel detent means 25 is provided to secure barrel means 10 to stock means 50 when the barrel means 10 is fully rotated into seated position. Recess 26 in barrel means 10 carries a spring mounted ball 27 which is driven into seat 28 formed in stock means 50 when barrel means 10 is fully seated. To facilitate quick separation of barrel means 10 from stock means 50, both may be knurled. Interrupted or other threads 41 may be threaded in opposite directions for left-handed and right-handed shooters, to minimize the rotation of barrel means 10 when the weapon is being cocked or fired to positively counteract the torque resulting from such cocking or firing when holding the barrel.

As shown in FIG. 2, threaded retainer 59 connects to the rear end of sleeve 51. The inner bore 59*a* of retainer 59 has a smaller inner diameter then bore 51*a* of sleeve 51. Rod 54 is rigidly connected as its rear portion to butt plate 55 and the forward portion 57 of rod 54 has a larger outer diameter than the outer diameter of rod 54. Sleeve 51 is maintained in proper alignment with butt 55 by a pin 48 carried by retainer 59. Pin 48 extends into a longitudinal slot 49 formed in shaft 54. Shoulder 56 of rod 54 seats against retainer 59 and prevents sleeve 51 from moving any farther forward then the position shown in FIG. 2. When the gun is fired, sleeve 51 is driven to the rear towards butt 55. The recoil is absorbed partially by spring means 60 and partially by recoil spring 63. During recoil pin 48 remains in slot 49, maintaining alignment of sleeve 51 with butt 55.

Spring means 60 comprises a first helical spring 61 and second helical spring 62. Spring 62 utilizes wire of substantially larger diameter than that used in spring 61. Springs 61 and 62 are mounted longitudinally in series inside sleeve 51. The forward portion of spring means 60 is urged against the rearward portion of inertial firing pin means 80. The rear portion of spring means 60 operates against forward surface 58 of rod 54. Spring means 60 drives inertial firing pin means 80 forward into contact with cartridge 32. When cartridge 32 has been fired, spring means 60 absorbs a portion of the recoil as sleeve 51 moves rearwardly from the position shown in FIG. 2 towards butt 55. By using a plurality of springs 61 and 62 with different spring constants of predetermined magnitude mounted in series, an exponential recoil absorption effect is provided wherein the greater the recoil, depending on the round fired, the greater the portion of the recoil absorbed by heavier spring 62. Spring 61 tends to compress first, and in the case of small rounds or rounds with minimum recoil, spring 61 will absorb the bulk of the recoil force. However, for rounds which generate intermediate recoil force, spring 61 will be fully compressed and heavier, spring 62 will absorb the bulk of the recoil force. For rounds with maximum recoil, recoil spring 63 comes into effect. Recoil spring 63 has a larger spring constant than spring 61 or spring 62. Recoil spring 63 is helical and mounted in series with springs 61 and 62 inside cylinder 64. Cylinder 64 may be plastic or metal and is joined to butt 55 by adhesive. Its forward end 65 is open and extends over sleeve 51 so that sleeve 51 slides into cylinder 64 during recoil, compressing recoil spring 63. A foam rubber cheek piece 66 covers cylinder 64 and provides a comfortable cheek rest and protective cover of recoil spring 63 and stock 50 for the user. Recoil spring 63 is not used in driving firing pin means 80. The spring constants of springs 61, 62 and 63 are selected to provide an appropriate range of absorptive effect for the rounds designed to be fired by the gun and an appropriate force against which trigger means 70 must be pulled to cock the weapon. It is possible to use three or more springs with different spring constants as part of spring means 60.

Another important feature of spring means 60 is the provision of ample force to drive inertial firing pin means 80 to pierce a compressed gas cylinder, described in greater detail below. Spring means 60 is capable of driving inertial firing pin means 80 forward with sufficient force to activate whatever particular round the user has selected, and is also able to absorb a significant portion of the recoil from the round.

As shown best in FIG. 1, rifling 21 is provided in barrel means 10, extending from the tip 20 of barrel means 10 towards breech 11 a distance of approximately five inches. The lands of the rifling are larger than the bore of barrel means 10 to facilitate the firing of minimum lethality, expanding projectiles such as taught in U.S. Pat. No. 3,710,720. Alternatively, rifling 21 may be deleted, leaving barrel means 10 smooth bored.

Can 23 removably attaches to the tip 20 of barrel means 10. Can 23 facilitates the firing of grappling hooks, line and other payloads.

FIG. 3 shows small rocket round 32 and barrel insert means 30 capable of accepting round 32. As shown in FIG. 3, barrel insert means 30 has approximately the configuration of a 12-gauge shotgun shell. It is cylindrical in nature and extends into breech 11 of barrel means 10 so that the rim 33 seats against stop 12 in barrel means 10. Inner bore 31 is concentric with the outer surface 34 of barrel insert means 30 and bore 31 is smooth. Rocket round 32 is held by a spring detent 35 to facilitate firing of the primer and provide rocket holddown until sufficient force has been generated by round 32 to deflect detent 35 shortly after detonation of rocket round 32. Detent 35 contains dual dimples to allow the use of rockets of different lengths. Instead of using a spring detent, a pair of split metal O-rings may be used, which are deformed outwardly after the rocket round is fired; or a pair of silicone rubber O-rings may be used; or a magnetic breech plate face 108 may be utilized to retain rocket round 32 in position until fired. Each of these alternatives is a rocket holddown means. Round 32 is guided by bore 31 of insert means 30 and then passes through the remainder of barrel means 10 without being guided by the front portion 14 of barrel means 10.

Use of a magnetic breech plate face 108 provides a convenient extraction mechanism for various barrel inserts and ammunition used in the weapon. After a round is fired, the user simply rotates the barrel approximately sixty degrees, and as the barrel means 10 is pulled away from stock means 50, the magnetic breech plate face 108 pulls steel inserts and spent cartridges from the breech 11 of barrel means 10.

FIG. 4 shows, in sectional view, barrel insert means 130 for use with rim fire round 132. Rim fire barrel insert means 130 comprises a cylinder 135 with a rim 133 which seats against stop 12 in barrel means 10. Inner bore 131 is rifled. The longitudinal axis of bore 131 is offset from the center of cylinder 135 by a distance which is slightly less then the radius of bore 131. In this fashion, when cartridge 132 is loaded into the recess 138 formed at the rearward end of bore 131, the rim 132*a* of round 132 is positioned at the center of cylinder 135 (as shown in FIG. 4A) to be struck by the firing pin described in greater detail below.

Figure 5:
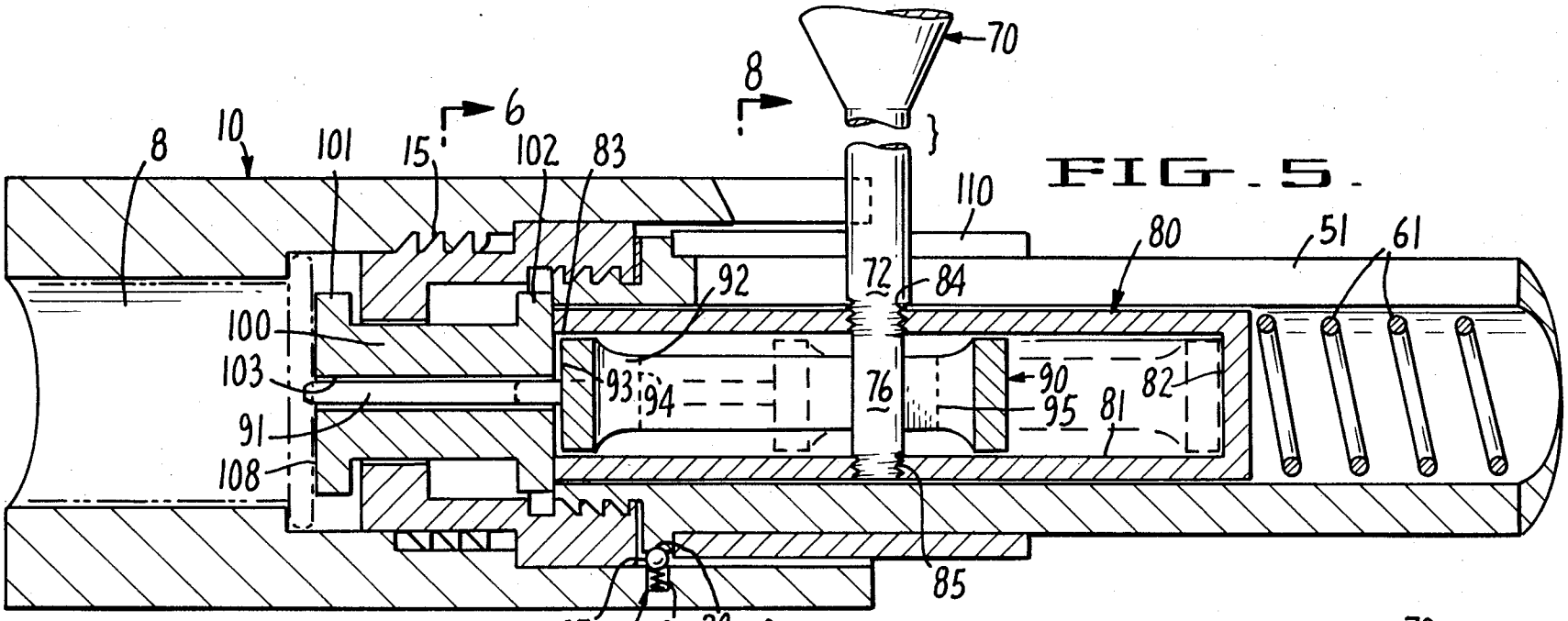
FIG. 5 is a sectional view showing generally the firing pin mechanism of the device shown in FIGS. 1 and 2.
Figure 8:
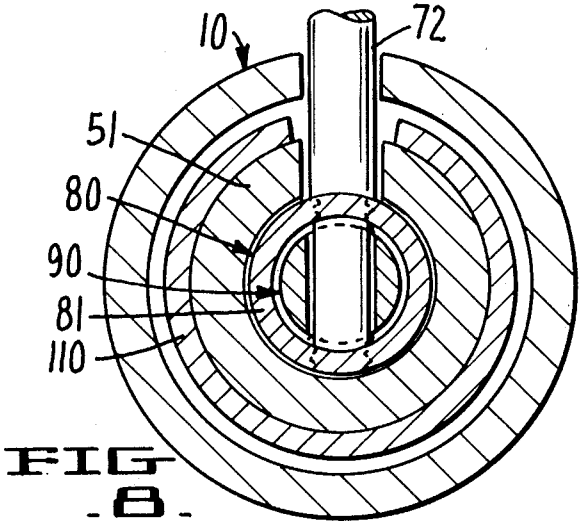
FIG. 8 is a sectional view along the line 8—8 of FIG. 5.
Figure 6:
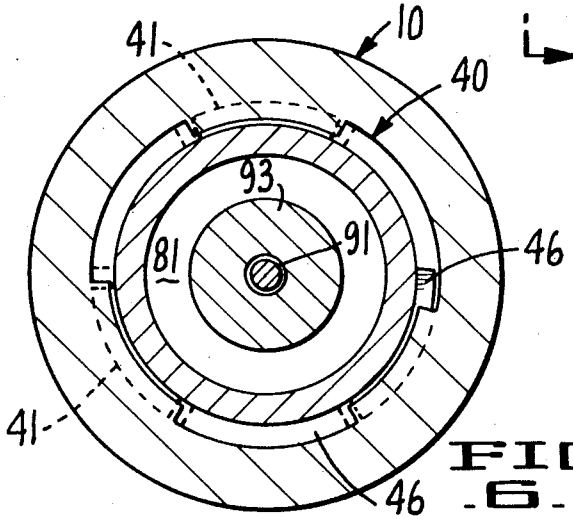
FIG. 6 is a view along the line 6—6 of FIG. 5.

Referring to FIG. 5, inertial firing pin means 80 is shown in its position of firing a center fire shotgun round 8. Inertial firing pin means 80 includes a firing ram piston 81 which is cylindrical having its rear end 82 closed, presenting a surface which is constantly urged against spring 61. The forward end 83 of piston 81 is open. At its center, piston 81 has threaded holes 84 and 85 into which shaft 72 of trigger means 70 is threaded, so that piston 81 moves forwardly and rearwardly in sleeve 51 with shaft 72 of trigger means 70. The center portion 76 of shaft 72 is relieved to permit quick unthreading of shaft 72. Inside piston 81 is a floating firing pin assembly referred to generally as 90. Assembly 90 includes pin 91 and slotted spool 92 which is rigidly connected to pin 91 at the forward cylindrical edge 93 of spool 92. Slotted spool 92 has an elongated slot formed therein which extends from dotted lines 94 through 95 and the slot is of such width that assembly 90 is free to move relative to shaft 72. In operation, when trigger means 70 is activated by rotating knob 73 and shaft 72, shaft 72 is driven through slot 52 in stock means 50 by spring means 60. Piston 81 moves forwardly with firing pin assembly 90 in the position shown in phantom in FIG. 5. Piston 81 moves forwardly and engages floating breech plate 100 which is cylindrical with rims 101 and 102 and a center bore 103 through which pin 91 may pass. Floating breech plate 100 is driven into the position shown in FIG. 5 by the seating of barrel means 10 against stock means 50. When floating breech plate 100 is seated against round 8, proper head space is formed between floating breech plate 100 and the base of a cartridge (head space is not critical for gas bottles or rocket rounds), assuring proper detonation of round 8. Floating firing pin assembly 90 then moves forward from the position shown in phantom in FIG. 5 to the position shown in FIG. 5 at which point round 8 is detonated.

Figure 9:
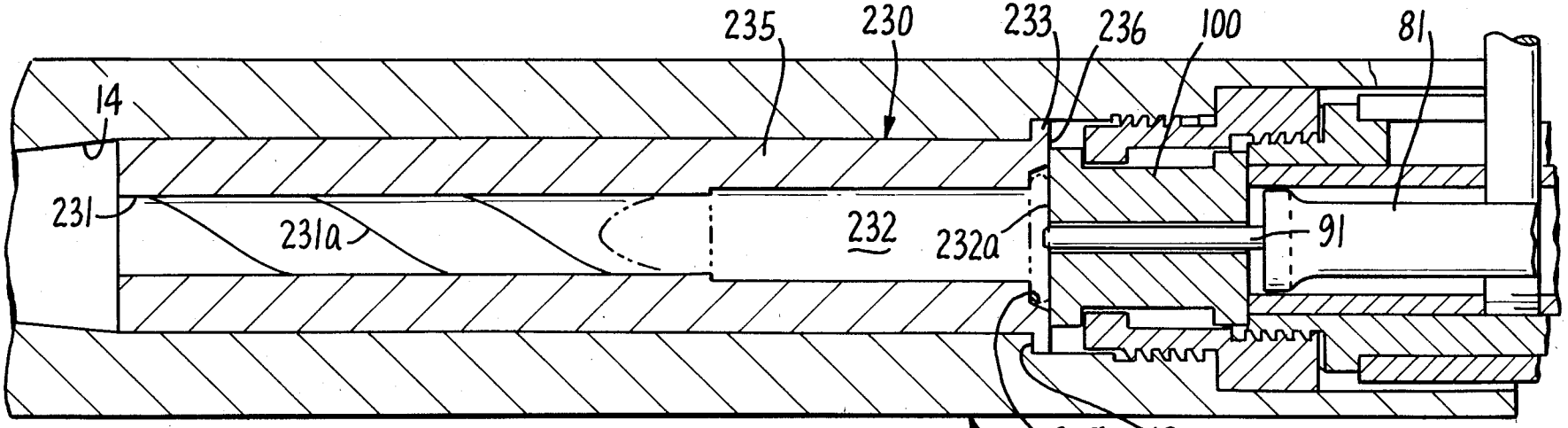
FIG. 9 is a sectional view of yet another barrel insert capable for firing center fire cartridges.

Referring to FIG. 9, the detonation of a center fire round 232 is shown. Barrel insert means 230 comprises a cylinder 235 with a rifled center bore 231, wherein the longitudinal axis of bore 231 coincides with the center of cylinder 235, pin 91 and the center of barrel means 10. Barrel insert means 230 has a rim 233 at its rearward end which seats against stop 12 of barrel means 10. Recess 237 is formed in barrel insert means 230 against which round 232 is seated. In the seated position shown in FIG. 9, the rearward surface 232*a* of round 232 is coplanar with the rear surface 236 of barrel insert means 230. As shown in FIG. 9, floating breech plate 100 is held in the position shown by the seating of barrel means 10 against stock means 50 in which position round 232 is fully seated and the proper head space again is provided, assuring proper detonation of round 232. When round 232 is fired, rifling 231*a* in bore 231 imparts spin and guides round 232 in its trajectory. Round 232 does not contact the inner surface 14*a* of barrel means 10.

Figure 10:
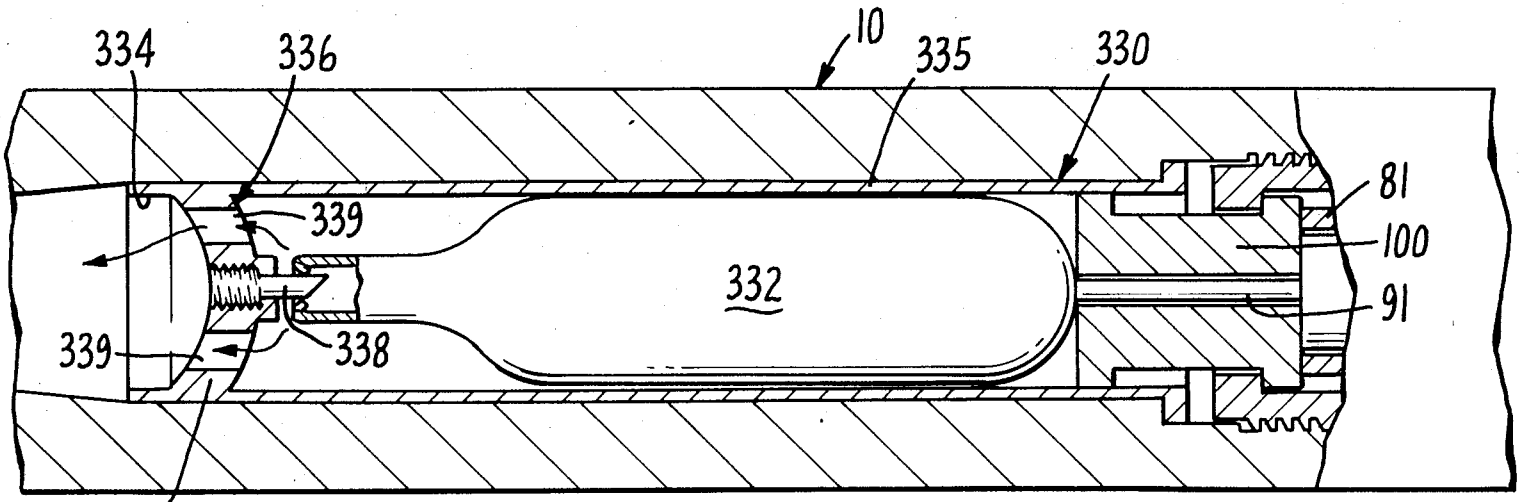
FIG. 10 is a sectional view of yet another barrel insert capable of firing compressed gas cylinders.

Referring to FIG. 10, a pressurized gas cylinder 332 is shown in position in barrel means 10 as it is fired. Barrel insert means 330 comprises a cylindrical sleeve 335 with a smooth inner bore 334 at the forward end of which is mounted compressed gas bottled piercing means 336 which is similar to the bottle piercing means disclosed in U.S. Pat. No. 3,830,214. Piercing means 336 includes a dome shaped support 337 which carries a threaded piercing element 338 at its center and which contains passageways 339 for the release of pressurized gas therethrough from cylinder 332. The piercing of cylinder 332 is accomplished by spring means 60 driving piston 81 and floating breech plate 100 to the position shown in FIG. 10. As can be seen in comparison with FIG. 9, floating breech plate 100 advances substantially farther in FIG. 10 in order to pierce gas bottle 332. Pin 91 advances forwardly to the position shown in FIG. 10 but in practice does not contribute significantly to the piercing of cylinder 332. The amount of force necessary to drive cylinder 332 against piercing element 338 is roughly ten times as great as the force required to detonate center fire or rim fire cartridges. The use of the floating breech plate in conjunction with the inertial firing pin means 80 allows the effective piercing of gas bottles and detonation of center fire and rim fire cartridges.

Referring to FIG. 1, the rear section of barrel means 10 has a notched camming surface 19 formed therein. One surface 19*a* of notch 19 forms a camming surface for shaft 72 of trigger means 70. Second surface 19*b* is parallel with slot 52. As trigger means 70 advances toward the position required to detonate a round, shaft 72 is driven against camming surface 19*a* which serves to rotate barrel means 10 to the position of correct head space for safe detonation of whatever round is ready to be fired. Conversely, if barrel means 10 is not sufficiently tightened with respect to stock means 50, shaft 72 of trigger means 70 will hit the rear surface 18 of barrel means 10 and will not enter notch 19. If shaft 72 stikes rear surface 18 of barrel means 10, the firing pin is unable to advance forwardly to a position to detonate a round. The function of notch 19 is on the one hand to provide a camming surface 19*a* which insures that the barrel is properly in place prior to detonation of a round and to also provide a safety means in case the barrel is not properly secured to stock means 50.

Also shown in FIG. 1 is front sight 17 which is a folddown sight incorporating hinge 17*a* and is shown in its folded position in the phantom portion of FIG. 1. Knob 73 of trigger means 70 has a V-shaped notch 74 formed at its top which provides a rear sight for the weapon. Rear sight 74 is registered with front sight 17 when it is in its cocked position in notch 53 and the registration of these sights provides a method of verifying full seating of the barrel relative to stock means 50 prior to firing the weapon; the registration of the sights also provides an indicator means that the weapon is cocked and ready to fire.

As shown best in FIG. 5, safety means 110 is provided which is a knurled sleeve carried on the exterior surface of sleeve 51. Safety means 110 has a longitudinal groove formed therein extending parallel with slot 52 and which must be registered with slot 52 in sleeve 51 in order to fire the weapon. When the trigger means 70 is in the cocked position shown in FIG. 2, safety means 110 may be activated by rotating it relative to sleeve 51. Safety means 110 may be provided with a small notch in which shaft 72 may be carried.

What is claimed is:

1. A gun capable of firing a variety of projectiles driven by a variety of propellants comprising:

stock means barrel means quick connect means for readily connecting said barrel means to and disconnecting said barrel means from said stock means, without requiring the use of any hand tools, a plurality of removable barrel insert means any one of which may be carried by said barrel means for supporting a predetermined propellant within a firing chamber defined by said barrel insert means, trigger means, and inertial firing pin means responsive to said trigger means, wherein said trigger means comprises a firing knob rigidly carried by a shaft and in which said stock means has a longitudinal groove formed therein in which said shaft may advance and in which said barrel means has a camming notch formed in the rearward end thereof in which said shaft may advance so that as the shaft advances into said camming notch, a camming action of said shaft against the surface of said camming notch ensures that the barrel means is fully seated against said stock means prior to full advancement of said inertial firing pin means.

2. The device of claim 1 in which the rear surface of said barrel means operates as a safety means by preventing forward motion of said firing knob and said inertial firing pin means unless said camming notch is positioned to allow full forward movement of said firing knob and said inertial firing pin means.

3. The device of claim 1 in which said firing knob has a V-notch formed in its upper surface which provides a rear sight for the gun.

4. The device of claim 3 further comprising a front sight carried by said barrel means and wherein longitudinal misalignment of said front and rear sights indicates improper assembly of the gun.

5. The device of claim 3 wherein the longitudinal alignment of said front and rear sights provides an indicator means that the weapon is cocked and ready to fire.

* * * * *